US008636631B2

(12) United States Patent
Carlson

(10) Patent No.: US 8,636,631 B2
(45) Date of Patent: Jan. 28, 2014

(54) ARRANGEMENTS FOR EXERCISING VIA SEMISPHERICAL MOTION

(76) Inventor: Alan L Carlson, Lago Vista, TX (US)

( * ) Notice: Subject to any disclaimer, the term of this patent is extended or adjusted under 35 U.S.C. 154(b) by 0 days.

(21) Appl. No.: 13/306,862

(22) Filed: Nov. 29, 2011

(65) Prior Publication Data

US 2012/0220428 A1 Aug. 30, 2012

(51) Int. Cl.
*A63B 21/00* (2006.01)

(52) U.S. Cl.
USPC ..... 482/139; 482/79; 482/80; 482/8; 482/127

(58) Field of Classification Search
USPC ..... 482/8, 139, 127, 79, 80
See application file for complete search history.

(56) References Cited

U.S. PATENT DOCUMENTS 1,707,791 A * 4/1929 Anderson ..... 482/72
3,205,303 A * 9/1965 Bradley ..... 348/211.4
4,149,713 A * 4/1979 McLeod ..... 482/101
4,640,268 A * 2/1987 Roberts ..... 601/24

* cited by examiner

*Primary Examiner* — Jerome W Donnelly

(57) ABSTRACT

A method is provided for exercising a human appendage that includes placing the appendage in contact with a user interface and placing a force on the user interface where the user interface based on a net user force becomes displace from an unbiased position to a biased position, where the user interface when moving from the unbiased position to the biased position moves about a path defined by a semispherical surface having defined by an origin, a radius and an angle of displacement.

19 Claims, 12 Drawing Sheets

Section A-A

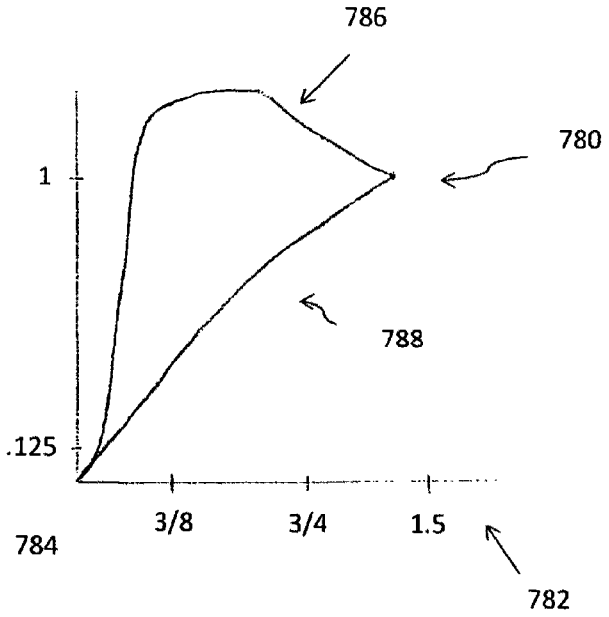
Figure 7C Radius Rope Turns In Fairlead

ARRANGEMENTS FOR EXERCISING VIA SEMISPHERICAL MOTION

FIELD OF THE INVENTION

This invention relates to a mechanical configuration that converts motion about a hemispherical surface to a linear motion. In a preferred embodiment the invention further relates to exercise equipment for the human body and having a user interface that moves about a three dimensional arcuate surface or a semisphere such that a user can exercise all muscles, tendons and ligaments that control movement of an appendage of the human body.

RELATED APPLICATIONS

Background of the Invention

Exercise has become an important part of life in the civilized world. It has been proven that exercise can increase longevity, can rehabilitate injuries, can prevent injuries, can improve athletic performance, and can improve the way of life for many. Current exercise methods and apparatuses provide less-than-perfect performance for exercising certain body parts. More particularly, body parts that have a full range of motion have portions of the motion (directions of movement) that cannot be properly or safely loaded by a force during exercise. For example, current exercise apparatuses do not provide an effective multidirectional loaded movement for exercising the neck, wrist, lower back, shoulder, etc because many body appendages such as the wrist and ankle, bend, pronate and rotate.

It is difficult if not impossible to exercise these body areas because these portions of the body move in almost all directions about a bone/socket arrangement or a vertebra-ligament-disk configuration. For example, the wrist can be exercised by curling a barbell but there is no apparatus which provide an exerciser a controlled load for moving the hand in a 360 degree rotation with pronation or other complex movement about the wrist joint. An additional shortcoming with modern exercise equipment is that improper exercise or uncontrolled joint movements can cause injury. An additional shortcoming with modern exercise equipment is that uncontrolled force in awkward positions or uncontrolled joint movements can cause injury. Although humans can move most joints 360 degrees, certain areas or ranges of movement are weak and too much load at a particular location and in a particular direction can tear connective tissue such as muscles ligaments and tendons. For example, during exercise with free weights, if the weight is too heavy or if the weight pulls the user into an awkward position, an exercise apparatus can easily tear muscles, tendons or ligaments causing injury.

Although humans can move a joint 360 degrees, certain areas or ranges are weak and too much load in a particular direction can tear connective tissue. For example, during exercise with free weight, if the weight is too heavy or if the weight pulls the exerciser into an awkward position, an exerciser can tear muscles, tendons or ligaments. Thus, controlling the motion of the exercise, the direction, the velocity of movement and amount of the force during the exercise can prevent injuries, yet exercise regions that are currently dangerous to exercise and thus underserved. There are also shortcomings in evaluating athletic performance or these non traditional motions and positions.

SUMMARY

The present invention provides a method and system for exercising appendages of the body such as an arm or leg that have multidirectional movement from their attachment to the body where the movement is substantially defined by a center and a radius. For example, movement of appendages such as the neck, arm, wrist, finger, ankle, leg, toes and the torso occur as generally defined by a three dimensional hemispherical surface having a center and a radius. Here-to-fore machines to provide proper therapy and strengthening for such body parts and appendages have been less than perfect. This is because to effectively exercise such an appendage requires a uniform resistance over a three dimensional hemispherical path where each of the infinite number of paths provides uniform resistance. A universal system for monitoring activities and motions during exercise and controlling the resistance provided to a user of exercise equipment over a full range of motion is provided.

In some embodiments a user interface is attached to a Y axis system that in some embodiments is a five bar linkage. A user interface provides a location for a user to connect to and exerts a force the system to move the Y axis rotation system from its unbiased position. When a user exerts a net force on the user interface, the Y axis rotation system will move from its un biased position corresponding to the direction of the net force exerted by the user and will translate and rotate the user interface about an X, Y, Z axis defined by a three dimensional arcuate surface. In other embodiments mechanical member of the Y axis rotation system can be configured so that they act as though they have a pivot point at the based of the users appendage created by multiple pivot points none of which are on the plane of the exercisers pivot point.

In some embodiments an exerciser can push on the user interface in any direction in the X-Y plane and the user interface follows a three dimensional arcuate path having a Z axis component and a rotational component when the user interface moves from its rest position or unbiased position. The linkages forces the user interface to rotate about the X or Y axis as the user interface translates to different locations about a semispherical surface that can be mathematically approximated by a single radius. The disclosed apparatus can be utilized to exercise muscles, tendons and ligaments that surround the base of any human appendage the have multidimensional movement in relationship to the core of the body. The apparatus can provide a wide range of motion for muscles tendons and ligaments that control human joints including vertebra where such movements are omni-directional or three dimensional movements where the rotational orientation of the user interface maintains rotational coordinates that are tangent to the hemispherical surface. Generally rigid members with pivot points can operate as control mechanisms to dictate the path traveled by the user interface continually adjusting the rotational angle of the user interface as the user interface translated to different locations on the semisphere.

The user interface can be attached to lead which attaches to a portion of the Y axis pivot system and can be connected to the resistance system to provide a resistive force to movement of the user interface as it moves from its unbiased position. The lead can be attached to a resistance system which can provide user selectable resistance setting based on the amount of resistance desired by the user.

During movement of the user interface the lead can move in and out from a static location created by fairlead holder which secures fairlead rollers. The resistance system can be a weight stack similar to those utilized by conventional fitness equipment. The force exerted by the user on the user interface can be measured over this entire range of motion of the user interface which can include a broad range of motion. A strain gauge can a motion or one or more position sensors can acquire data regarding the users performance and this information can be transmitted over a wireless network and can be accessible via a webpage for access by the user, a physician, a trainer, or an insurance company employee. In another embodiment the location of the fairlead and possibly the resistive system can be adjustable or moveable to different locations to create different pre-selectable starting locations (bias positions) for the user interface. In some embodiments the location of the contact points of the user interface that make contact with the user can be changed in relation to the pivot points to adjust the path that the user interface will travel. Thus adjustment mechanism can change the radius that defines the movement of the user interface.

There are many shortcomings in evaluating athletic movements and performance during non-traditional motions and movements and positions. Current exercise methods and apparatuses provide limited monitoring for the exerciser and do not have a way to measure force, distance, direction and acceleration provided by the exerciser over a full range of motion which is safely loaded. The deficiencies above are particularly prevalent in exercise equipment for body parts which have rotational movements (as opposed to hinge movements) such as the neck, wrist, lower back, shoulder, etc. Many joints such as the wrist and ankle bend pronate and rotate and current exercise machines cannot detect the path or rotation of the user's movements. Although humans can move most joints 360 degrees, certain areas or ranges of movement are weak and too much load at a particular location and in a particular direction can tear connective tissue such as muscles ligaments and tendons. Thus, controlling the resistance of the load, the acceleration and velocity of the user interface while detecting the amount and direction of the force during the exercise has here-to-fore been unachievable.

BRIEF DESCRIPTION OF THE DRAWINGS

FIG. 7C is a graph of the radius of curvature made by the lead as the roller yokes pivot during operation.

DETAILED DESCRIPTION

Figure 1A:
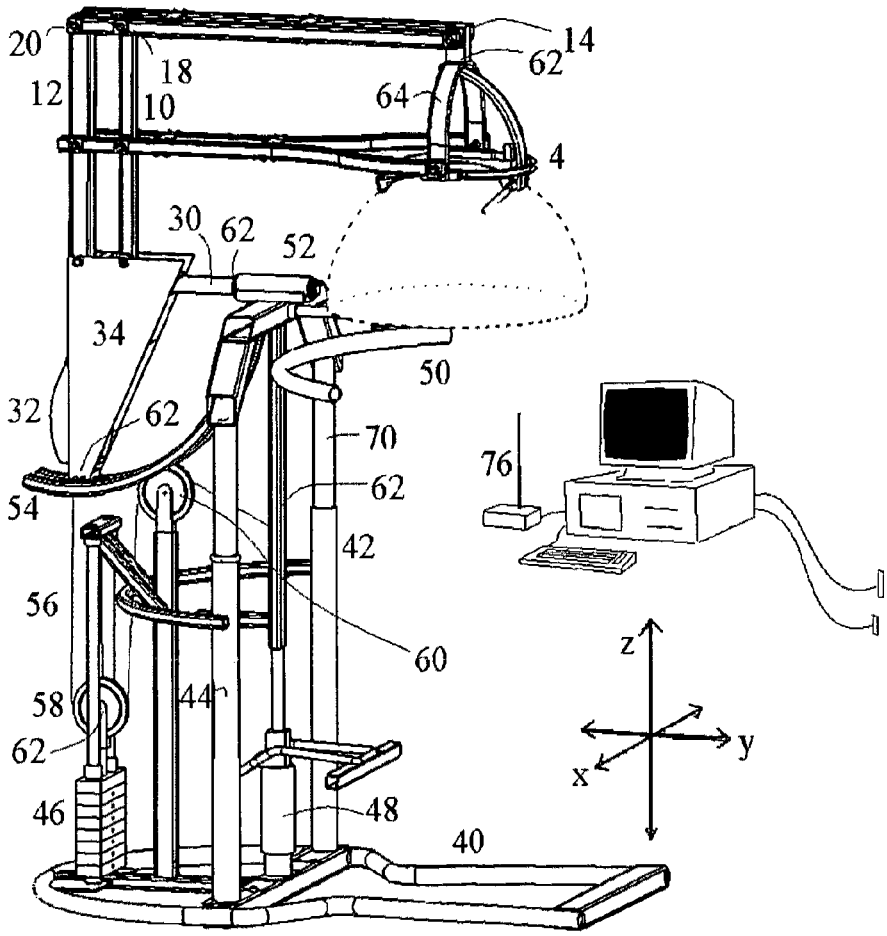
FIG. 1A is an orthogonal view of an exercise apparatus that confines the movement of a user interface (and an exerciser's appendage) to locations that can be substantially defined mathematically by a semispherical shell.

The following is a detailed description of example embodiments of the invention depicted in the accompanying drawings. The example embodiments are in such detail as to clearly communicate the invention. However, the amount of detail offered is not intended to limit the anticipated variations of embodiments; on the contrary, the intention is to cover all modifications, equivalents, and alternatives falling within the spirit and scope of the present invention as defined by the appended claims. In the following description, like reference characters designate like or corresponding parts throughout the figures. Additionally, in the following description, it is understood that terms such as "first," "second," and the like, are words of convenience and are not to be construed as limiting terms.

In some embodiments the disclosed fitness and rehabilitation apparatus can be utilized to exercise appendages and utilize a universal monitoring system that provides a wide range of force strength exertion stress strain torsional stability, etc. measurements under a controlled resistance to a user's movements. The monitoring system can monitor forces occurring over a semisphere based on a three-dimensional motion or an appendage while the strength of the appendage is matched to a resistance setting of a variable resistance system. The resistance system can provide a controlled and measurable resistance to movement of a user's appendage about the entire semisphere.

Referring to FIG. 1A an exercise apparatus 1 is illustrated. The exercise apparatus 1 can include a user interface 4, a Y axis pivot system 2, a base 40, rigid members 6-14 and a resistance system 46 such as a weight stack 48. The Y axis pivot system 2 can be supported by base 40 and can pivot or rotate about the Y axis in relationship to the base 40. The Y axis pivot system 2 can be a five bar linkage that translates and rotates the user interface 4 about the X and Y axis in relationship to the base 40.

The Y axis pivot system 2 can utilize five substantially rigid mechanical members that pivot in relationship to each other and can rotate as a group about the Y axis or remain static about the Y axis, while pivoting about an X axis which can be defined in relationship to the base 40. The Y axis pivot system 2 can confined movement of the user interface 4, the movement defined by a center or origin and a radius that defines a semispherical shaped surface as the user places a net force on the user interface 4 to move the user interface 4 from its unbiased position. Alternately described, when a user pushes on the user interface 4, the user interface 4 can move from a rest position in a direction in response to the net force and can rotate and follow an arcuate path that is tangent to the motion of and a surface of the users appendage. The path traveled can be dictated by the distance from the user's joint to the contact point on the users extremity such that the same contact point of the user that initially engages the user interface 4 maintains the same point of contact as the user moves their appendage over a full range of motion.

The Y axis pivot system 2 can be coupled to or include the user interface 4, upper horizontal member 6, lower horizontal member 8, first vertical member 10, and second vertical member 12. When a net force is applied to the user interface 4 in the Y direction first vertical member 10 and second vertical member 12 can pivot about one or more X axis as the user interface 4 moves in relationship to the base 40. Simultaneously, with the first vertical member 10 and second vertical member 12 rotating about a second and third X axis spaced approximately six inches apart as shown in FIG. 2B. The user interface 4 can have three pivot points, including an upper or first user interface pivot 14, a first side or second user interface pivot 16, and second side or third user interface pivot 17. The second user interface pivot 16 and third user interface pivot 17 points can be co-linear or coplanar. The upper horizontal member 6 can have a first pivot 18, a second pivot 20, a third pivot 22, a fourth pivot 24, a fifth pivot 26, and a sixth pivot 28.

Referring to FIG. 1 an "imaginary" arcuate surface 10 (shown by a dashed line) is included to illustrate the range and path of movement of a user interface 4. The arcuate surface 10 is comprised of points in three-dimensional space (X-Y-Z) that are substantially equidistant from a center 11. It may be easier to think of the arcuate surface as the exterior surface of an "upside down bowl." The three dimensional arcuate path of the user interface 4 (defined by a center 11 and a radius 12) can be implemented by different mechanical configurations some of which are illustrated in FIGS. 2 and 3.

Alternately described the imaginary arcuate surface can be referred to as semisphere or a semispherical surface in space and such a surface can be represented mathematically by the implicit function theorem as the graph of a function, "f", of two variables, in such a way that the point p is a critical point, i.e., where the gradient of vanishes as can be attained by a suitable rigid motion or motion of a rigid body. In such a configuration the Gaussian curvature of the surface at p is the determinant of the Hessian matrix of "f" (as defined by the product of the eigenvalues of the Hessian matrix where the Hessian matrix is the 2-by-2 matrix of second derivatives). This mathematical definition is made to make a distinction between cup/cap and or versus a saddle point.

The surface integral of the Gaussian curvature over a region of the travel of the user interface over the surface can be referred to as the total curvature of the semisphere. Gauss's Theorema Egregium (Latin: "remarkable theorem") states that Gaussian curvature of a surface can be determined from the measurements of length over or on the semispherical surface itself In fact, given the full knowledge of the first fundamental form expressed via the first fundamental form and its partial derivatives of first and second order can dictate the surface equation or path traveled by the user interface. Equivalently, the determinant of the second fundamental form of the semispherical surface can also be expressed. The "remarkable", and surprising, feature of the application of this theorem to the present invention is that although the definition of the Gaussian curvature of the semispherical surface depends on the way in which the surface is located in space, (based on different machines designed to exercise different appendages) to provide the end result, the Gaussian curvature itself, is determined by the inner metric of the surface without any further reference to the ambient space, i.e., it is an intrinsic invariant. In particular, the Gaussian curvature of the present invention can be invariant under isometric deformations of the surface.

In contemporary differential geometry, the "semispherical surface" can be viewed abstractly, as a two-dimensional differentiable manifold. To connect this point of view with the classical theory of surfaces, an abstract surface can be embedded into the semispherical surface and endowed with the Riemannian metric given by the first fundamental form. The Gaussian curvature of a sphere of radius R has constant positive curvature R. In multivariable calculus, the implicit function theorem is a tool which allows relations to be converted to mathematical functions.

Movement of the user interface 4 can be defined mathematically by a partial sphere or semisphere. Movement of the user interface 4 in response to a net user force can also be defined as a partial hemispherical shell or surface having an annulus. The surface can be thought of as a small region of space between two concentric spheres of slightly differing radii, possibly by just a fraction of an inch. This mathematical description of a shell can include a thickness of a quarter of an inch to describe the inner and outer limits of the movement of the user interface 4 as it moves through its full range of motion. Such a shell thickness can provide the limits of travel of the user interface 4 taking into consideration design abnormalities, manufacturing tolerances, deformation of the piece parts, play due to wear etc. Thus the shell thickness can mathematically describe or define boundaries which the user interface 4 will stay within during operation.

In some embodiments in order to mathematically define the paths traveled by the user interface 4 we can make a distinction between a two-dimensional hemispherical spherical surface embedded in three-dimensional Euclidean space and a "ball" or the three-dimensional shape consisting of a sphere and it's interior. Using analytical geometry a sphere can be defined as a locus of points (x,y,z) having a center ($x_0$, $y_0$, $z_0$) and radius r where $(x-x_0)^2+(y-y_0)^2+(z+z_0)^2=r^2$ For a semi sphere or half of a sphere we can limit x y and z to x>0, y>0 and z>0. A more accurate mathematical description of the movement of the user interface 4 might limit the radius to 15 inches and might limit z being greater than 5 inches. The points on the sphere with radius r can be parameterized via the equations $$x=x_0+r\sin\theta\cos\theta;$$

$$y=y_0+r\sin\theta\sin\theta$$

$$z=z_0+r\cos\theta$$

$$\text{for}(0\leq\theta\leq 2\pi \text{ and } 0\leq\theta\leq\pi)$$

The Y axis pivot system 2 can be mounted to the base 40 via a Y axis pivot shaft 30 and a Y axis pivot bearing 54 which can provide a smooth rotation of the Y axis pivot system about the Y axis. The Y axis pivot 30 allows the Y axis pivot system 2 to pivot about the Y axis as shown by rotational arrow 31 in FIG. 2B. The second or main vertical member 12 can have a counterbalance 32 attached proximate to the fairlead assembly 702. The counterbalance 32 can bias the position of the user interface 4 as the force of gravity pulls down on the counterbalance 32 thereby moving the user interface 4 to a pinnacle location on the semisphere. Thus, the counterbalance 32 can move the Y axis pivot system 2 and the user interface 4 such that when no user force is applied to the user interface 4, the user interface will move to an upright, unbiased position without assistance from lead 56 and the resistance system 46.

Y axis pivot system 2 can simultaneously translate and rotate the user interface 4 as it moves from its unbiased position to provide a three dimensional arcuate movement for the user interface 4 defined by a radius as dictated by the distance from the user's appendage pivot point to the contact location to the appendage on the user interface 4. For a neck exercising machine the radius could be on the order of 12 inches. A body appendage can be attached to, connect with the user interface 4 which is when acted upon by a net force will translate and rotate. The user interface 4 can be coupled to a resistance system 46 via lead 56. In some embodiments the lead 56 and the resistive system 48 can hold the user interface 4 in a rest position or unbiased position and the lead 56 in combination with the resistive system 46 can resist movement of the user interface 4 from the rest or unbiased position during exercise.

Figure 1B:
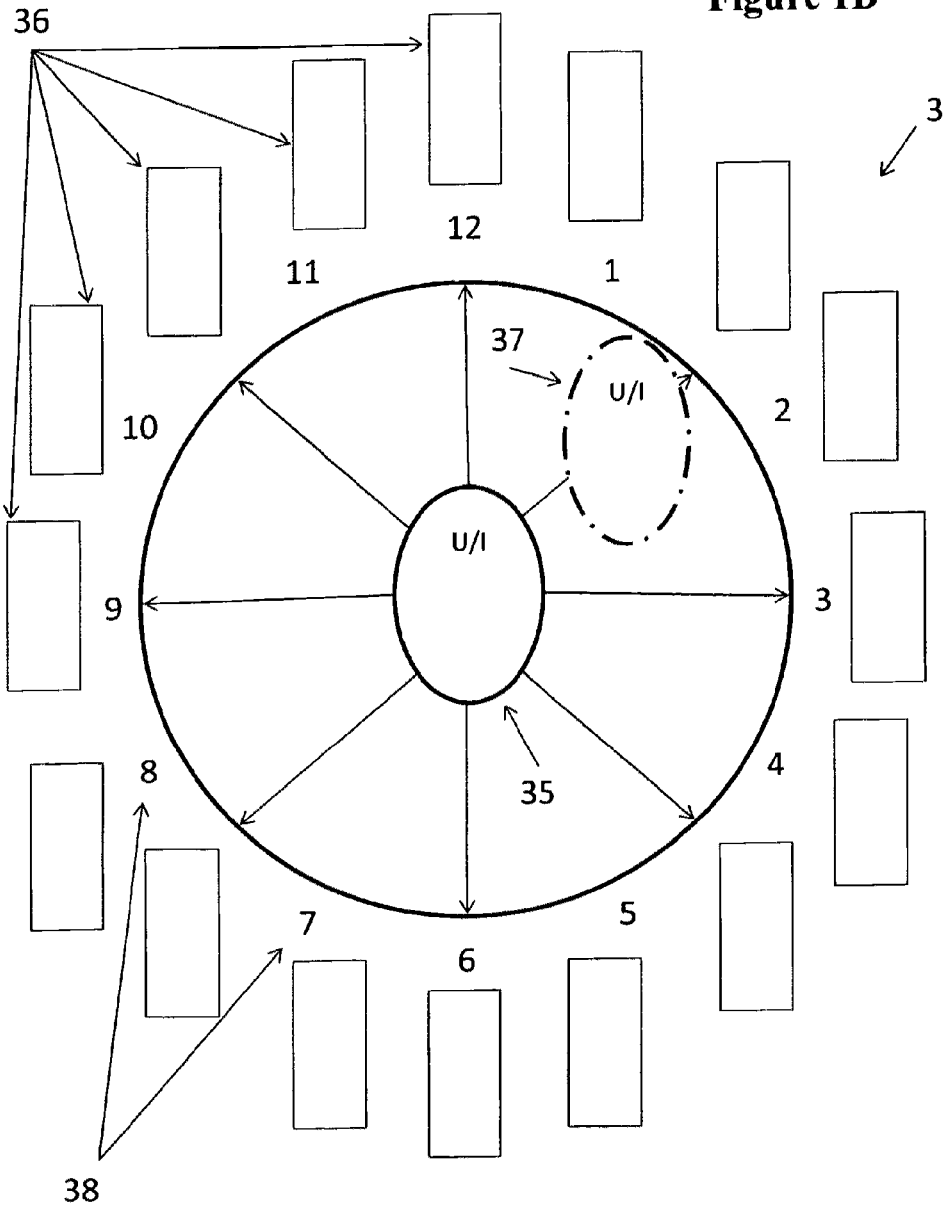
FIG. 1B shows a graphical user interface GIU providing a top view of the user interface and the clock coordinates associated with movement of the user interface.

Referring FIG. 1B, a graphical user interface 3 is shown. The movement of the user interface 4 can be defined using clock coordinates. Referring briefly back to FIG. 1A, just above the apparatus 1 section A-A is provided which can allow for describing locations and movements of the user interface. Thus the clock coordinates 38 can be assigned in relationship to the base of the apparatus to communicate the direction in which the user interface moves or can be moved. The user interface is shown in an unbiased or rest position 35 at the center or origin of the clock and is also shown in phantom moved between the 1 and 2 o'clock position 37. Data boxes 36 can display data associated with movement of the user interface in a particular direction. For example the data boxes could include the force, distance, rotation, acceleration flexibility, percent muscle balance, work, fatigue etc. that a user has exhibited in a particular direction of the clock system.

Figure 2A:
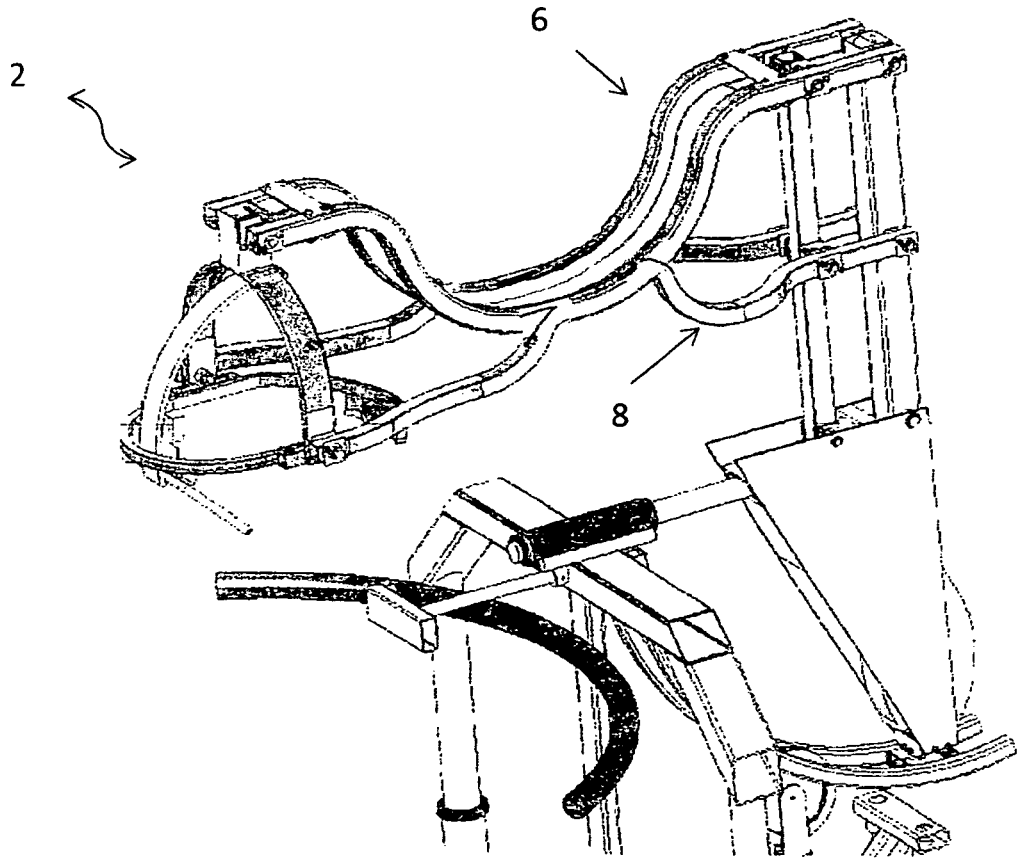
FIG. 2A depicts a side view of the Y axis linkage portion of the exercise apparatus connected to the frame in an unbiased position.
Figure 2B:
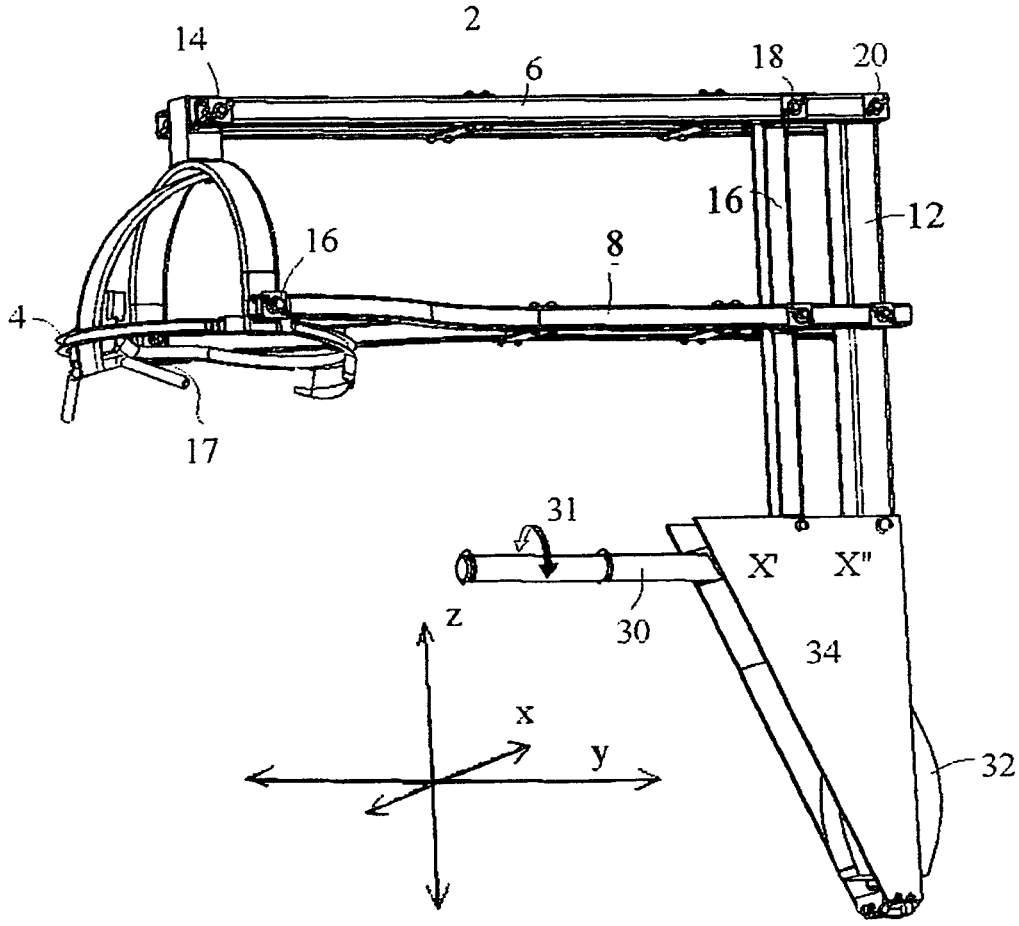
FIG. 2B depicts a side view of the Y axis linkage portion of the exercise apparatus connected to the frame in an unbiased position where the linkages are separated to assist in describing the invention.
Figure 3:
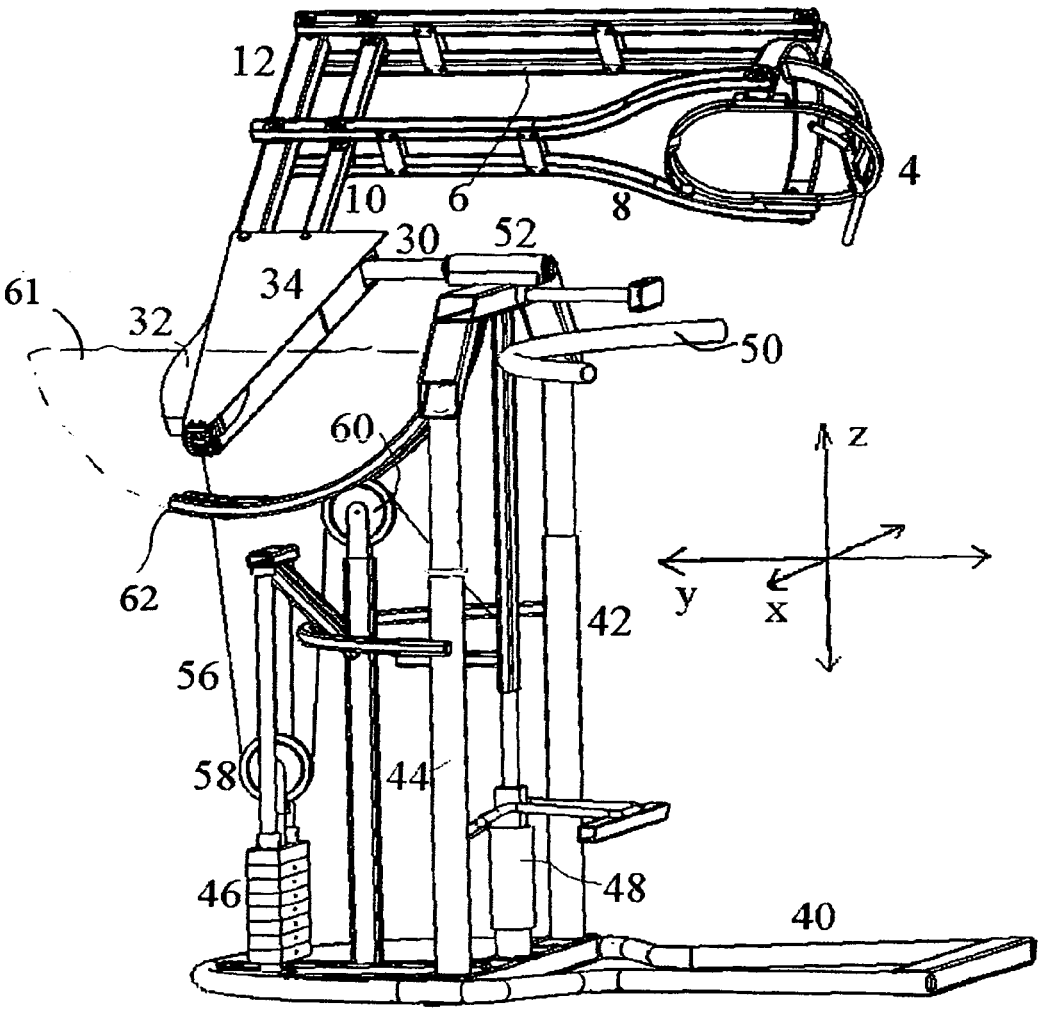
FIG. 3 illustrates a side view of the Y axis linkage portion of the exercise apparatus in a rightward biased position or a three o'clock position.

Referring to FIG. 2A a partial orthogonal view of the exercise apparatus 1 is illustrated focusing on the Y axis pivot system 2 portion of the apparatus 1. FIG. 2 shows a possible arrangement where the upper horizontal member(s) 6 and lower horizontal member(s) 8 are adapted such that their horizontal portions lie in the same plane and are interleaved. Such a configuration provides certain advantages, however, for ease of explanation the apparatus 1 the majority of figures illustrate a configuration that is believed to be easier to explain and understand.

Referring to FIG. 2B another view of the exercise apparatus 1 is illustrated where the user interface 4 can move about a semisphere. FIGS. 2A and 2B illustrate a functionally similar embodiment to that shown in FIG. 1, but from a different perspective or view. In the embodiments shown, the user interface 4 is in the form of a headgear for placement on a user's head and the apparatus 1 is specialized for exercising the neck, however this embodiment is not intended to be a liming factor as the invention is applicable to many different body parts including all appendages.

During operation as a user pushes on the user interface 4 in the X direction, the Y axis pivot system 2 will pivot about the Y axis pivot bearing 52 forcing the user interface 4 to move down in the Z direction as it moves in the X direction. Alternately, if the user exerts a force in the Y direction members 8-14 pivot in relationship to each other via pivots 18-28 forcing the user interface 4 to move down in the Z direction as it moves forward in the Y direction. Whenever the user applies a force in any combination of an X-Y direction the user interface 4 can move in relationship to all pivot points (14-30) as the user interface 4 traverses an arcuate path.

The fairlead assembly 55 is illustrated directly above the unbiased position of the vertical member 12 and can guide the lead 56 as it moves in response to the movement of the user interface 4 to provide resistance to an exerciser's movement. The lead 56 and fairlead 55 provide a resistance to movement of the user interface 4 that is substantially equal in both the X and Y direction as the user can push the user interface in all directions and receive substantially the same amount of resistance.

It can be appreciated that the bottom of the Y axis pivot system base 40 only moves in an arcuate motion while the counterbalance moves about a semisphere. Thus, when the user interface is in the 2, 4, 7 and 9 o'clock position the lead 56 will traverse and change directions at two different fair lead assemblies. This allows the user interface 4 to provide resistance at any point on the semisphere as long as the user interface 4 is moving away from the unbiased or rest position.

In some embodiments, the apparatus can be set to provide a relatively small resistance to a user such that a "weak" human can utilize the apparatus therapy or rehabilitation. The apparatus disclosed can provide resistance to movement of a user interface 4 in four dimensions during exercise while providing a substantially uniform resistance to the users efforts over the user's entire range of motion. Such a low and uniform resistance can be provided by a counterbalancing system embodied by counterbalance 32.

Utilizing the apparatus, a user can get positioned such that their bone socket or vertebra to be exercised is at the center point or origin of the semispherical path traveled by the user interface 4. As the user pushes on the user interface 4 (in any all directions in the X-Y plane) the movement of the user interface 4 can be confined to the semispherical path traveled by the a push point on the user's appendage as the joint or vertebra rotate thereby providing a seamless user direction control. Thus, the part of the body that engages the user interface 4 will move in unison with the user interface 4 to any point the user desires in the range of motion as defined by the semisphere while a resistive system provides a uniform resistance to the user's movement.

In some embodiments the user interface 4 can be coupled to the resistance system 46 with a cable or lead 56 which holds the user interface 4 in a rest position and resists movement of the user interface 4 away from the rest opposition. Lead 56 can exit from and can retract to fairlead assembly 55 during exercise. The distance between linkages in the apparatus 1 can force the user interface 4 to translate through the XYZ planes as it rotates about the axis of the user interface at the desired ratio, i.e. translation to rotation. For example the user interface can rotate 30 degrees as it moves 12 inches, providing approximately a two to one ratio, degrees rotation to distance translated. The distance between the joints in the linkages can dictate the radius of the section of spherical path traveled by the user interface 4.

The device is particularly effective when an individual has a need for therapy on muscles that pull and push an appendage in a particular direction. A user can push the user interface 4 to any desired location on the "imaginary" semispherical surface. The range and shape of motion of the user interface 4 is not intended to be a limiting factor, with irregular shaped members and adjustment in the dimensions between pivot points and the user interface or between joints of the six bars linkage and the user interface, the movement of the user interface 4 can be about a path described by many different equations such as a parabolic equation.

The user interface 4 can translate as it rotates and moves over the semispherical path with a path or axis that remains substantially tangent to a curved surface. In some embodiments the path can become farther from a perfect semi sphere as the user interface 4 moves from top dead center to about a 45 degree angle from the unbiased or XYZ origin about any of the X, Y or Z axis. All points of the semisphere can be umbilics. Sections of the semisphere that are all normal section can have an equal curvature. Thus coordinates or locations that the user interface 4 can travel on the path can be umbillick. In some embodiments the surface defining the travel ad range of the user interface 4 can be a surface defined as where a conical solid intersects a hemispherical surface where the hemisphere and the cone have the same origin and radius and in some embodiments the surface area can be defined as a quartersphere having an area of $4\pi r^2$. If a radius carved out the boundary of the semispherical surface the radius at a 45 degree angle, the user interface can be rotated about the X Y or Z axis and travel a path having maximums defined by where the conical solid the hemispherical surface.

In some embodiments the resistance system 46 can include weight pulley 58, weight stack 48. Changing the distance from the user interface 4 to the upper horizontal member 6 using path adjustment 64 can alter the path traveled by the user interface 4. A path adjustment 64 can be placed between the user interface 4 and the upper horizontal member 6. In FIGS. 1-18 like elements have like callouts. Three dimensional motion tracking system to track the movement of the user interface 4 and the user of the equipment. Fairlead holder 54 (a fairlead track) can be utilized to move the fairlead assembly 55 to a desired location above the imaginary arcuate surface The apparatus described has tailored the teachings herein for a specific embodiment or apparatus as a neck machine. Other machines such a wrist machine would have linkages that have similar ration between the linkages to create the desired translation and rotation on the semisherical surface. Machines on all scales can be created because different appendages of the body move three dimensionally. Each appendage specific machine can have a user interface 4 that moves based on a radius that accommodates the length of a user's appendage generally and more specific where the user's appendage contacts the user interface 4. However, as described above minor path modifications can be made by path adjustment 64 because a user having a shorter bone or shorter radius about his pivot point will require a smaller radius of travel than a long boned person.

If during movement of the appendage, the user interface 4 does not track the contact point between the appendage and the user interface 4 an adjustment can be made to change the pivot ratio about either the X axis or the Y axis. Adjustable chest pad 7 can move in relationship to the based 40 or user interface 4 and can be adjusted by the user into a position that will properly align and possibly hold the user in relationship to the user interface 4 during exercise. In addition, the user interface 4 can resist, or force pronation, (outward rotation) and/or supination (inward rotation) of an appendage for special therapy as every muscle in the appendage could be exercised.

Figure 7A:
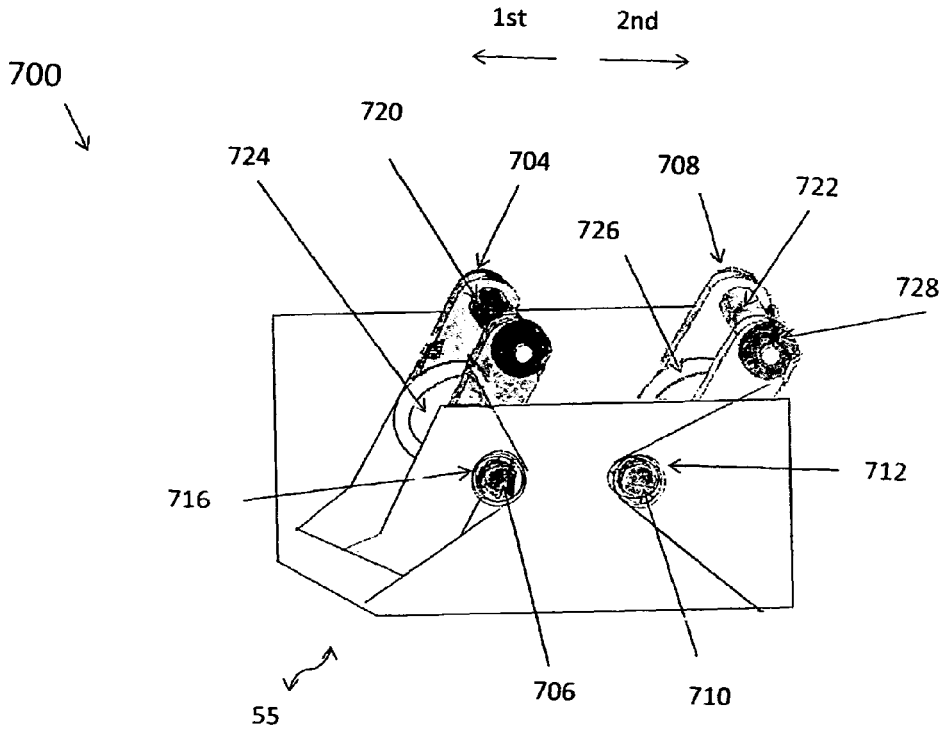
FIG. 7A is a side view of a fairlead assembly.
Figure 7B:
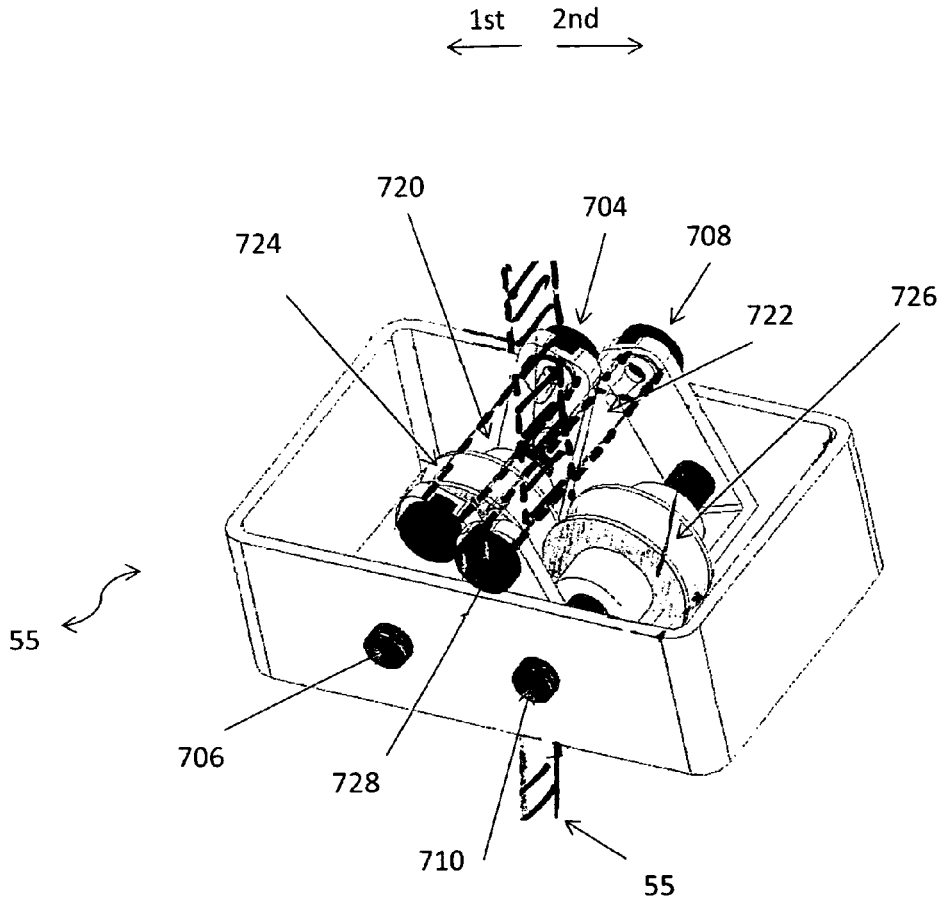
FIG. 7B is an orthogonal view of a fairlead assembly with rollers and a lead drawn in phantom.

In the exercise apparatus 1 of FIGS. 1, 2 and 3 described above, a user can push on user interface 4 in nearly any direction and the user interface 4 will provide a controlled movement and a controlled resistance in response to the a force caused by a movement of a body part about its joint or vertebra. Resistance to movement of the user interface 4 from its rest location can be provided by a lead 56 (wire or rope) that is coupled to the user interface 4. The second end of the lead 56 can be attached to a resistance system 46. Resistance system 46 can be a weight, a spring, an elastic cord, a gas charged shock or any other device which can provide a resistance to movement of the lead 56 and can return the user interface 4 to its rest position. The amount of resistance provided by the resistance system 46 can be adjusted by moving first adjuster 13. The lead 56 can be a rope, a cable or a chain and the lead 56 may be routed through pulleys 60 and 58 prior to attaching to the resistance system 46. The lead 56 should be durable, robust, flexible and wear resistant it can be made from Kevlar, nylon, polyester, polypropylene, technora, spectra and vectran some of which are trademarks. The lead 56 can move through a fairlead assembly 55 which can guide the lead 56 as moves in relationship to the frame as it spools to the resistance system and recoils towards the resistance system during exercise. There can be four sets of rollers in the fairlead assembly 55 that can be comprise of more than eight rollers. Pulleys or sheaves that essentially forming a very small and spring loaded "orifice" controlled by a user adjustable travel limiters such as limiters 728 and 729. The rollers can guide the lead 56 from this self-adjusting orifice as the lead flows in and out of the orifice according to the distance the user interface 4 travels during exercise. It is preferred that when the user interface 4 is in its rest position the outside or biased rollers are "as close as possible" to keep the user interface 4 in an upright position when no net force is applied to the user interface. This reduces the amount the user interface 4 can move before the resistance system 46 starts to provide a noticeable resistance. The illustrations of in FIG. 7A-C provide a more detailed description of the fairlead assembly 55 that can be used with the current invention and its dynamic features.

In a preferred embodiment the fairlead assembly 55 can be moved to a predetermined location prior to the start of the exercise. Thus, the starting location for the exercise or the rest or unbiased location of the user interface 4 can be user adjusted to most if not all positions on the semisphere. In some embodiments the fairlead assembly 55 and the resistance system 46 can be placed on a fairlead holder 54 which is moveable above the imaginary semispherical surface. For example the resistance system could be a Spiraflex® by Nautilus® where the resistance provided is independent of orientation with gravity and is not heavy and easy to move about the semisphere that is a "mirror semisphere" or fractional mirror hemisphere to the path of the user interface. This feature allows the user to start an exercise at any location on the imaginary arcuate surface.

Sensors 62 can be placed proximate to moving parts of the exercise apparatus 1 to monitor and take data regarding a user's complex body motions under load. Force and distance vectors can be determined in three dimensions can be determined by gathering data from the sensors and when the sensor data from the apparatus is combined with sensor data from the users body from ultrasound, motion capture, magnetic resonance imaging or X rays, combining this data can reveal complex nerve and muscle activity and movement. The force vectors and muscle and nerve data can be utilized to provide data for diagnosing problems in motor skills, injuries rehabilitation progress and to monitor recovery or responses to therapy and exercise. Knowing the position, force and velocity of a body part in complex motion can give insight into performance, irregular movements of a joint area of movement which is weak due to damaged tissue and other phenomena. This data can also be used to analyze current performance and suggest changes in motion or strength conditioning that can increase performance, mobility of flexibility, seriousness of injury, recovery from injury or surgery and to test maximum strength in any given position. Methods for sensing data can be done with position, force, deformation and velocity sensors 62.

Alternately described, when a user's force moves the user interface 4 the point of contact between the user and the user interface 4 will be maintain and minimal slippage will occur between these surfaces as a user rotates their appendage about the base off the appendage. As discussed above the user interface 4 can be fixed to Y axis pivot system can rotate about Y axis pivot 30 or a virtual pivot point to provide the arcuate motion to the user interface.

It can be appreciated that exercising the connective tissue such as muscles, tendons and ligaments that surround an appendage such as an ankle, wrist finger spine, elbows, shoulder sockets, knee hip ankle etc. These embodiments will be useful to athletes that have a weak connective tissue who are possibly because of injury prone to knee, groin, hip, and ankle injuries. The exercise apparatus 1 allows an athlete to strengthen all connective tissue which surrounds the base of an appendage and increase the flexibility of an all appendage bases.

It can be appreciated that a pinnacle of an appendage when extended will move about a pattern defined by a semisphere. If counter balanced correctly to make the members "weightless" the semispherical path traveled by the user interface can be any part of a sphereical surface. In some embodiments, the members 6-12 can have dimensions, connection points and a counter weight such that the members 6-12 control a path of motion of the user interface 4 (about a semisphereical surface) similar to that of a soccer style kicker. It can also be appreciated that the apparatus could be adapted to exercise each finger and the hand about the wrist.

The disclosed mechanical configuration allows for combinations of muscles and ligaments located about the knuckles of the hand and wrist to be exercised where heretofore exercising such individuals muscles, ligaments and tendons and combinations thereof were hard to efficiently and effectively exercise. Thus, the user interface 4 can be implemented as a finger hole, a finger or handgrip, a mitten (not illustrated) or any other type or shape which can provide one or more push points or pull points for the user.

In some embodiments a wrist exercise apparatus 1 can be utilized to test the performance of and rehabilitate individuals that have carpal tunnel problems by analyzing muscles and tendons activity using a medical sensor 62 while the tissue is under load by the present invention. Using adapter 23 the wrist embodiment allows the user to pronate the wrists during rotation.

By changing sizes of the members and the ratios of the distance between linkages the user interface can travel in a path that is a smaller diameter or even a distorted semispherical surface across an axis. For example the members could be configured such that the user interface 4 as a grip of a club, bat or racket will track a user's actual natural free movement and the members 6-12 can be controlled such that they create a motion by the user that is believed to be an improvement in the users form.

In other embodiments the user can attach their sports equipment racket, club, bat etc possibly at the head of a club bat racket and the user interface 4 will follow a path that more closely approximates the movement of the equipment during a "swinging" In some embodiments that apparatus could be light weight and adapted to track the motion of a hand during a throw. Using the sensors users such as golfers or batters can learn about the orientation of the face of the equipment what effect altering his stance, back swing, size of equipment or other physical parameters achieve or do not achieve.

In some embodiments the disclosed configuration can have at least one sensor but potentially many sensors or motes, possibly smartdust forming a robust wireless self configuring sensor network. The motes can be specialized to detect one or more physical parameters of the exercisers activity via various phenomena at various locations. The motes can measure physical parameters such as force, acceleration, strain, direction, deceleration, distance rotation, range of motion associated with movements of the user. The resistance system 46 can provide an adjustable and variable resistance to the user while the sensors 62 can monitor the forces on, movement of and track traveled by the user interface 4. The disclosed sensor configuration can provide valuable data regarding complex movements of a user's torso and all appendages such as the arms, legs, neck, wrist, ankle over a full range of motion. A net force on and position of the user interface 4 can be measured over the entire range of motion using force and position.

Such a configuration that auto reports usage of and parameters associated with an individual undergoing rehabilitation under a therapy plan could be used by an insurance company to track the effort of and the rehabilitation of the user and be able to use such data in a court of law to reduce fraud in the system.

In some embodiments the user interface 4 can twist about its Z axis even as it rotates due to translation to accommodate the possible movement of a user's appendage such as how a head can twist about the spinal axis of the body or the wrist twists about the arm axis. Thus, the disclosed embodiments can accept a push, pull or twist on the user interface 4 or any combination thereof and the resulting force on, and displacement of user interface 4 can be measured and recorded. A wireless access point 78 can be place in proximity to the sensors and can make the data available via an online application service provider using a browser. The sensor/monitoring system 77 can provide measurements related to the users input and using data from a large cross section of society or users can provide feedback to each user regarding the exercisers movements over the confined range of motion. The sensor/monitoring system 77 can use sensors 62 to detect physical parameter of an exerciser's activity such as force, acceleration, direction, velocity, and movement of a portion of a user's body in relationship to other areas of the body. From example from the users center of gravity to the tip of an appendage or from the base of an appendage to the tip of the appendage.

The sensors 62 can be coupled to a user interface 4, to pivot points, to members, to the resistance mechanism 46 and/or to a cable or lead 56 connecting these parts of the system. Sensors 62 can measure a users input forces and displacement from a particular location and differential thereof, such as the distance from the user interfaces starting location to a location on the semispherical surface that has a maximum displacement therefrom. Sensors can also measure the direction of the users force on the user interface 4.

Sensors 62 can be mounted such that they sense moving parts, move with moving parts such as the lead and the user interface 4 or can detect movement, orientation and can detect change in orientation of the moving parts such as the user interface 4. More specifically, the sensors 62 can sense changes in the speed acceleration and orientation of the user interface 4 occurring responsive to a user's force. More particularly, changes in the orientation of the user interface 4 could be distance traveled, rotation, direction moved, forces applied, fluidity of motion, acceleration, velocity, and path traveled. After an adequate amount of data is acquired by the sensors 62 and a database coupled to the wireless access point time lapsed data can be tracked to calculate a user's work input and using estimate or know physical characteristics of the user, calorie burn, fatigue, fatigue rate and other parameters. Sensors 62 couls also acquire data regarding a user's physiological parameters such as heart rate, body temperature, grip strength, blood pressure, and other parameters. The sensors 62 could be notes or smart dust and or battery powered micro server nodes that communicate with many other nodes to gather a composite picture of the users output and range of movement and strength throughout the detected range of motion.

Strain sensor 12 could be a micro electro mechanical system (MEMS) based device, a capacitance based device or any other technology which can measure the deflection or strain on a component or pull on lead 56. Strain sensor could provide a very accurate measurement of the pulling or pushing force of the user on the user interface 4. The cornering or bending of lead 56 around weight pulley 58 and height adjust pulley 60 can change the force required to move the user interface 4. A relatively accurate measurement of the force exerted by the user on the user interface 4 can be determined using a strain gage where lead 56 connects to user interface 4.

A motion capture system (MCS) 95 can be placed in the room with the apparatus 2. The MCS 95 can use facial recognition to identify each user and can track the motions of the user, the user interface and other parts of the apparatus 2 such as the weight stack. The MCS 95 can track and capture or record movements and can translate the movements into a three dimensional digital model. The MCS 95 can record movements of one or more users/exercisers by sampling many times per second to provide animation data that can be mapped to a 3D model where the model performs the same actions/movements of the user or exerciser. The MSC can have a camera that transmits invisible near-infrared light and measures its "time of flight" after it reflect off of the user or parts of the apparatus 1.

The motion recognition system can us the time-of-flight data to track motion similar to how sonar works. The MCS 95 can distinguish movement of the user or user interface within 1 centimeter. The system can utilize middleware to recognize/identify a user people and distinguish a user's body parts, joints and movements. In some embodiments the MCS 95 can perform gesture recognition using feedback from infrared sensors to continually monitor the depth of various objects in the room by comparing the feedback received from one sensor to feedback received from other sensors just centimeters away. In some embodiments the MCS 95 can use a skeletal model that breaks down the human body into dozens of line segments that are drawn between joints in every part of the body, possibly from the position of the head and neck, down to the position of individual fingers and toes. The MCS 95 can using this skeletal model and predicted known or common physical motions and break these motions down into distinctive combinations of skeletal segments.

For example, exercising of the neck would be detectable by the movement of the head and continuously calculating the angle of the head in relationship to the shoulders, then monitoring those segments for a rapid change in acceleration to be able to calculate other parameters of the exercise. To minimize false recognition, the MCS 95 can recognize the machine it is monitoring and return a degree of certainty in its calculations, corresponding to the particular machine and the defined motion and the range of motion of the particular machine. In some embodiments one or more sensors attached to the user interface will have the ability to sense acceleration along three axes. The sensor could be an ADXL330 type accelerometer. The sensor network could also include optical sensors such a PixArt optical sensor, allowing the MCS 95 to detect a direction that the user interface is facing. In addition a sensor 62 can be utilized to detect rotation of the user interface 4 with respect to the ground or with respect to user's body. Such detection can be calculated from the relative angle of points on the user or user interface. A sensor bar could also be utilized to sense forward-backward motions of the user interface providing a 3-dimensional animation for the user interface.

The MCS 95 could utilize a light system with a colored light serving as an active marker where the position of the active marker can be tracked along an image plane by a fixed location sensor. The marker can have an image size enabling the position of the user interface to be tracked in three dimensions with high precision and accuracy. The MCS could use a sphere-based distance calculation to allow the user interface to be tracked with minimal processing latency, when compared to other camera-based control technologies. In some embodiments the user interface can include a pair of inertial sensors, a three-axis linear accelerometer and a three-axis angular rate sensor, which can accurately track rotation as well as overall motion. An internal magnetometer can also be utilized for calibrating the user interface's orientation against the Earth's magnetic field to help correct against cumulative error (drift) by the inertial sensors. The inertial sensors can be used for dead reckoning in cases which the camera tracking is insufficient, such as when the controller is obscured behind a cover or member of the apparatus.

Sensor 62 may be a miniature motion based sensor such as an inertial measurement sensor or an angular rate sensor such as a gyro, a laser ring, a piezo or crystal-based sensor such as a thin film piezo-sensor, a global positioning sensor a MEMS gyro, a ring laser gyro, a fiber optic gyro, and accelerometer or a micro-machined vibrating beam sensor. In some embodiments the sensors network can include a dual-axis tuning fork gyroscope, and a single-axis gyroscope which can determine rotational motion. The information captured by the angular rate sensor can then be used to distinguish true linear motion from the accelerometer readings. This allows for the capture of more complex movements.

Sensor 62 can measure movement or motion as well as torsion, acceleration and velocity of the user interface 4. The data can be sent to transmitter 11 and the data can then be sent to local computer 74. Using stored motion data the local computer 74 can display the path of the user interface 4 and the forces exerted on the user interface 4. A sensor such as an accelerometer could be utilized to measure the percentage of fast twitch and slow twitch muscle fibers utilized during an exercise. Correspondingly, local computer 74 could suggest a routine for developing each type of muscle fiber or specific muscles. Sensors 62 can contact the exercisers skin and detect the user's condition. Through skin of the user sensors 62 can detect human parameters such as body heat, pulse and grip strength.

The access point can be a personal computer and the sensors 62 can each have a transceiver allowing then to send data they acquire to local computer 74. Local computer 74 can relay the sensor signals to remote computers via the Internet 78. Local computer 74 can collect and store data, process data, display data real time and create web pages for transmission over the Internet 78. Local computer 74 can also analyze and compare a suggested exercise routine with a routine that is in process. The suggested exercise routine can be prescribed by a specialist such as a medical doctor, a physical therapist a trainer or a chiropractor. Sensors 62 can provide real time feedback regarding the quality of the movements based ion the suggested routine. Local computer 74 can provide real time data and display suggested movements or motion for the user to perform or whether the exerciser is using proper form. Local computer 74 can receive and process data and use various sensor data to provide useable data graphs, charts explanations and other info about the user's routine to the medical professional who suggested the routine. Insurance companies can save waste if an injured agrees to have his therapy monitored as the system can use the data from the monitoring to detect fraud.

More particularly the sensors 62 can determine the motion of the user and local computer 74 can provide real time feedback and inform the user to change something about the way he/she is exercising or to stop work it the exerciser is over exerting him or if harm may be imminent. Local computer 74 can also compile data from many exercise or therapy secessions and analyze the data to determine if therapy, rehabilitation or exercise is improving a user's strength flexibility, and/or performance. The user interface 4 is depicted as a member that can engage a head at the forehead level however the user interface 4 could be a straight or curved bar a handle, a flat, curved or circular shaped padded surface or any other shape capable of engaging a portion of the body.

In some embodiments the apparatus can automatically uniquely identify the user. Such identification can be done using smart card or RFID technology. In other embodiments the apparatus can have a keypad to accept users identity input or can have a human feature (biometric) recognition interface or fingerprint, voice, or other recognition system. User input could be provided and data could be displayed via a touch sensitive display 19 to receive user input and display entertainment or data during a user's movements. Three dimensional force vectors and six degrees of measurements can be determined using the sensor data. Combining the sensor data in the user interface 4 with sensor data from the user's body from ultrasound, magnetic resonance imaging or X rays, complex nerve and muscle activity can be analyzed. The force vectors and muscle and nerve data can be utilized to provide data for diagnosing problems, or detecting injuries and to monitor recovery or responses to the therapy. Performance data can be stored by the Local computer 74 by processing position, force and velocity of a body part in complex motion and comparing the motion to a predetermined pattern.

Sensor data can also be used to analyze current performance and based on a prescribed therapy the system can suggest changes in motion, exercise routines or strength conditioning that can increase performance, mobility or flexibility, and reduce the possibility of injury, recovery from injury or surgery and to test maximum strength or acceleration, in any given position location or direction.

In some embodiments the exerciser can place a reference sensor 19 on his torso or at the base of a body appendage to be exercised to give local computer 74 a reference position such that the relational motion of the body appendage can be determined. A motion detector 82 can be placed in the user interface 4 and the sensors 62 can be off until motion detector 82 detects motion and powers up the sensors 62 and the transmitter 76. Sensors 62 can record position, force, deformation and velocity in relation to the center of gravity, torso or joint of the user.

The disclosed apparatus can be effectively detect who might get injured by using data related to the general public and the specimens use of the apparatus. The disclosed method can also be used to prevent injuries wherein when the exercise motion being performed places a joint in an awkward position the forces can be controlled reducing the exercisers vulnerability to injury. Free weights such as barbells do not work well for this application for they can become too heavy in certain positions and pull the user into an awkward position tearing muscles, tendons or ligaments causing injury. Specifically, irregular movements of a joint, or movement of body appendages to positions that are weak due to damaged tissue and other phenomena can be monitored and controlled using the present invention.

Referring to FIG. 3 a side view of the Y axis pivot system 2 assemblies of the exercise apparatus 1 is illustrated. The Y axis pivot system 2, is shown with the user interface 4 moved to a biased position in response to net a force by an exerciser. FIG. 3 also illustrates the user interface 4 moved to a right biased position or to a three o'clock position. Covers 61 and 62 are illustrated that can prevent someone from entering the space where the counterweight and the Y axis base move to avoid injury due to moving parts.

Figure 4:
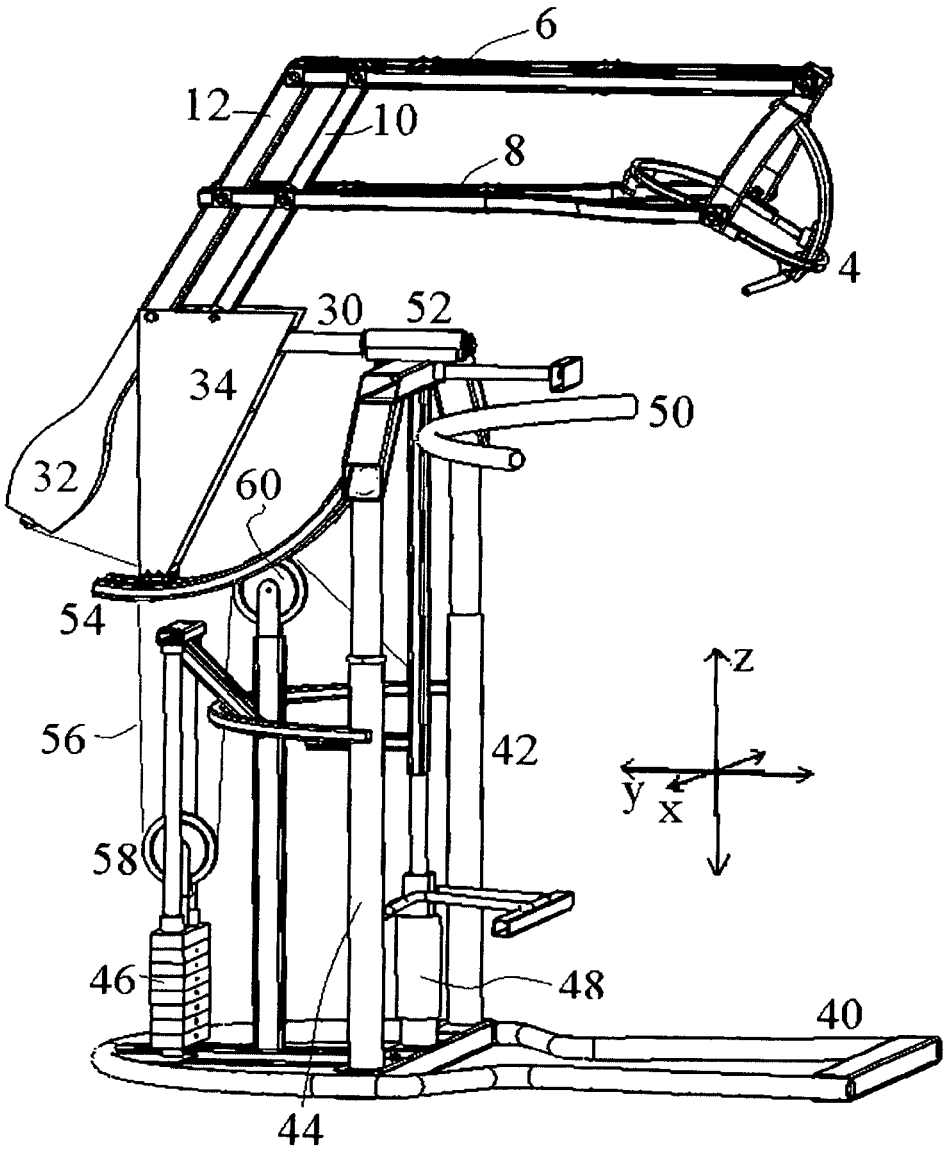
FIG. 4 depicts a side view of the Y axis linkage portion of the exercise apparatus in a back biased position or a six o'clock position.

Referring to FIG. 4 an orthogonal view of the exercise apparatus 1 is depicted. The view provided shows a direction that an exerciser could move the user interface 4 by push along the X axis thereby moving the user interface 4 forward biased at the six o'clock position.

Figure 5:
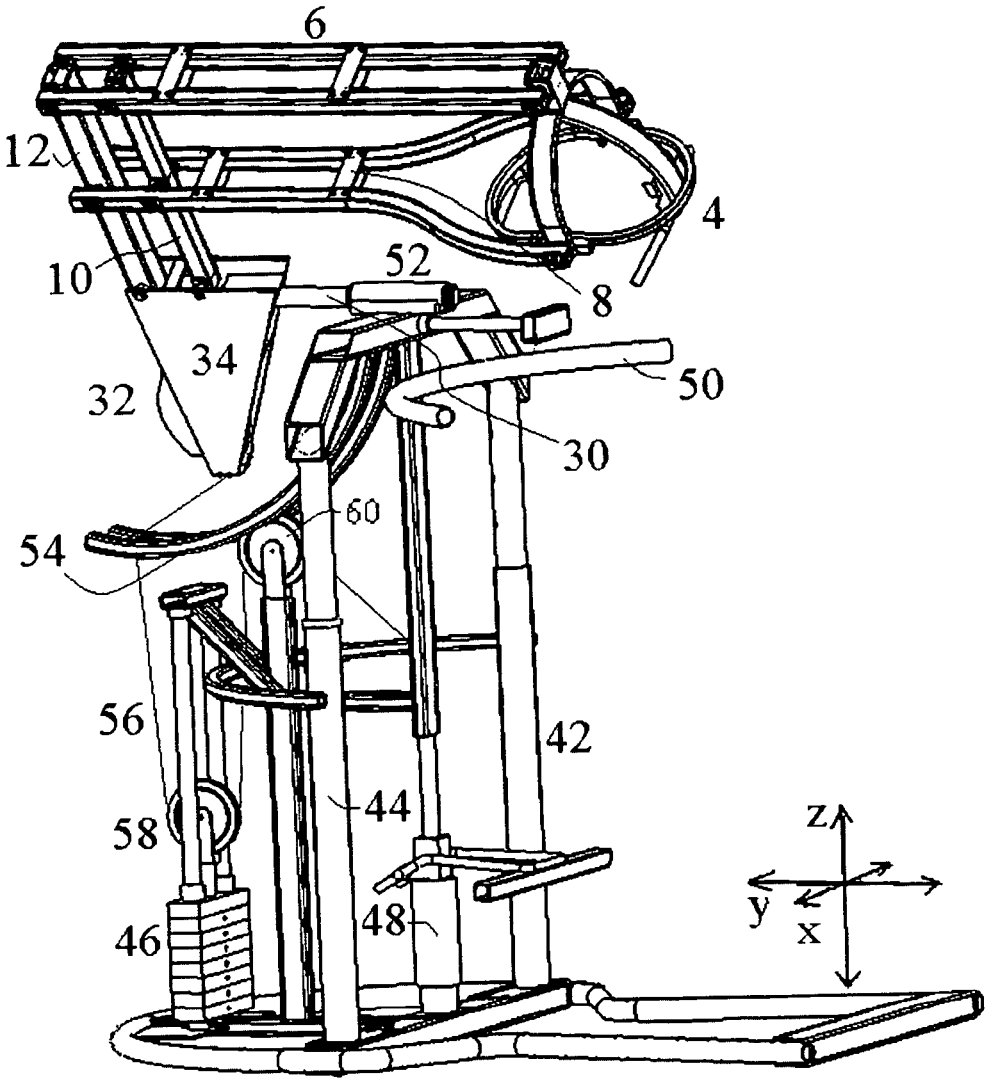
FIG. 5 is an orthogonal view of the exercise apparatus showing the user interface in a left biased position or a nine o'clock position.

Referring to FIG. 5 an orthogonal view of the exercise apparatus showing the user interface 4 moved in a left position in response to the exerciser's net force biased left at a nine o'clock position.

Figure 6:
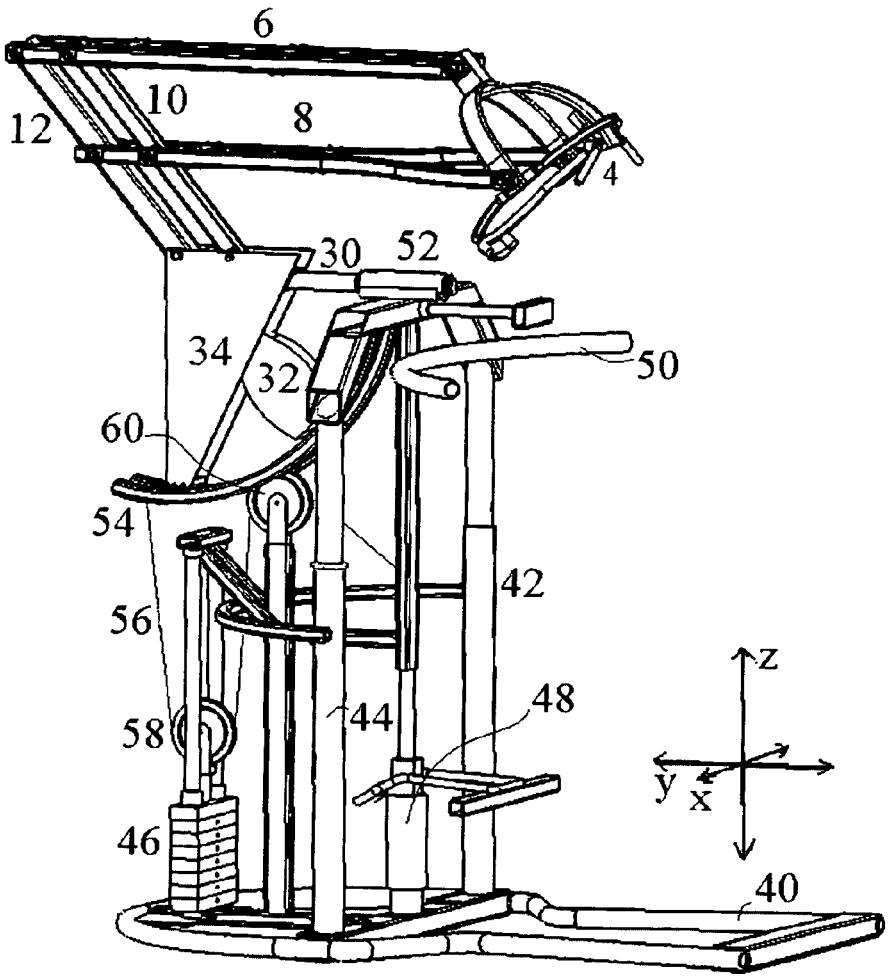
FIG. 6 is an orthogonal view of the exercise apparatus with the user interface in a forward biased position or a twelve o'clock position.

Referring to FIG. 6 an orthogonal view of the exercise apparatus showing the user interface 4 moves in a backward biased or twelve o'clock position.

Referring to FIG. 7A a side view of a fairlead assembly 55 is illustrated. The fairlead assembly 55 can include a frame that holds first roller yoke (FRY) 704, second roller yoke (SRY) 708, FRY pivot 706, SRY pivot 710, FRY spring 716, SRY pivot 712, first roller 720, second roller 722, first pulley 724, second pulley 726, and bearings 728.

Lead 56 can connect the resistance system 46 to the user interface 4 and can run through the fairlead assembly 55 more particularly can run between FRY 706 and SRY 708. The first and second roller yokes 706 and 708 can be spring loaded by FRY spring 706 and FRY 708 such that when the user interface is at rest, or in an unbiased position, the lead 56 can be pinched between a first roller 720 and a second roller 708. This feature allows for a smooth transition as the lead transitions through the unbiased position (i.e. when the lead does not exhibit a force on either of the first roller 720 and the second roller 722) the spring load on the rollers 720 and 708 reduce any slack during the transition in directions.

When lead 56 moves in the direction of first roller 704, FRY 720 will pivot about FRY pivot 706. When lead 56 moves in the direction of second roller 722, SRY 708, will pivot about SRY pivot 712. FRY spring 716 can bias FRY 706 towards the center of the fairlead holder 54 and SRY spring 716 can bias SRY 708 towards the center of the fairlead holder 54 such that there is no or a minimal gap between the lead and the first roller 720 and second roller.

In addition FRY 704 and SRY 708 and FRY spring 716 and SRY spring 712 can minimize the slack and play in the system and make for a seamless transition as the lead 56 transitions from riding on the first roller 720 to riding on the second roller 722. The spring loaded feature can also reduce the radius which the lead 56 has to travel increasing the life of the lead.

Travel limiters 714 can limit the travel of the FRY 704 and SRY 708 such that the rollers do not travel past a center point or too far away from the center point and that the rollers only move a predetermined distance away from the center or unbiased position. The range of motion for the FRY 704 and SRY 708 can dictate the radius which the lead is subjected to as an increased radius will improve the service life of the lead 56. Referring briefly to FIG. 7C, the change in radius provided by one configuration of the travel limiter settings of the fairlead assembly 55 is shown During operation the lead 56 can move the FRY 706 to a location where the lead fully engages the first pulley 724 or second pulley 726 depending on the direction the user interface travels. As the lead 56 applies force to a first roller 720, the first roller yoke 704 begins to pivot about the FRY pivot 706, movement of the FRY 704 will cause FRY spring 716 to flex and provide resistance to the user interface as the lead travels over rollers 720, 722, 730 and 732. Having FRY 720 and the SRY 722 spring loaded allows the rollers to pinch the lead 56, creating a smooth transition of the user interface as the lead moves from contacting the first pulley 724 to contacting the second pulley 726.

Referring to FIG. 7B another view of a fairlead assembly is illustrated. Components or elements in FIG. 7B having the same callouts are the same components as shown in FIG. 7A.

Referring to FIG. 7C is a graph of the radius of curvature made by the lead as it exits the fairlead is illustrated. The graph 780 shows the effective radius experienced by the lead 56 as it exits the fairlead assembly 55. Generally a smaller radius creates maximum wear on a rope or cable and the fairlead assembly described herein can provide a radius of curvature that is greater than the individual rollers or pulleys which the lead will engage as it moves in and out of the fairlead during operation or as a user exercises. Refer to FIGS. 7A and 7B to see the effective curvature of the lead as the yokes spring back and forth during operation of an exercise.

Figure 8:
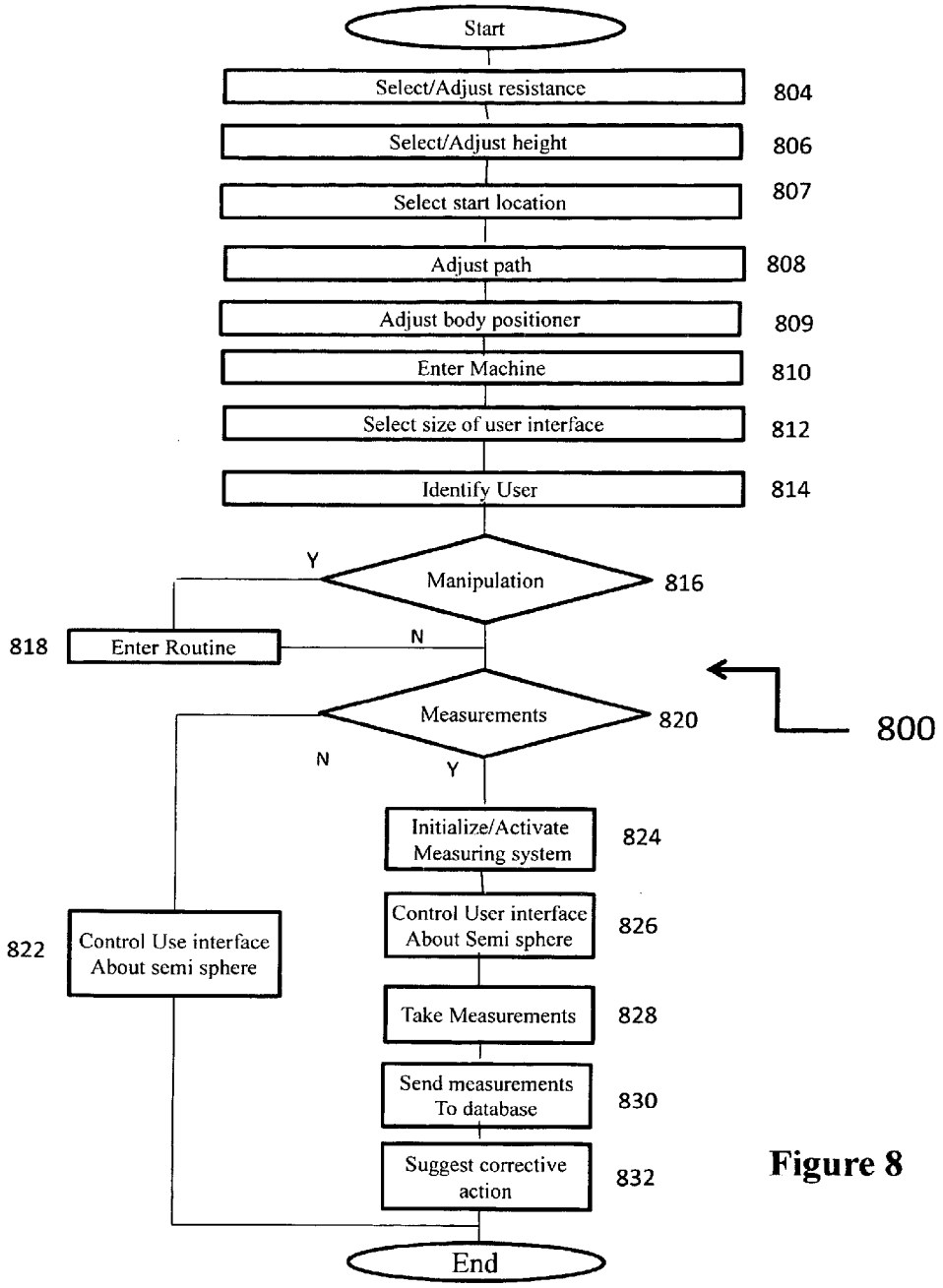
FIG. 8 is a flow diagram illustrating a method for exercising a body appendage.

Referring to FIG. 8, a flow diagram 800 is illustrated. As illustrated by block 804, a user can select and adjust the resistance provided by the resistance system. As illustrated by block 806, a user can select and adjust the position of the user interface in space such that the user is located in a desirable position in relationship to the user interface, to better align the movement of the appendage push point with the path of the user interface.

As illustrated in block 807, the start location of the user interface can be adjusted to any position on the semisphere. As illustrated buy block 808, the user can adjust path traveled by the user interface. This path will generally be dictated by a radius that defines the imaginary semispherical surface traveled by the user interface.

As illustrated by block 809 the user can adjust a body positioner such that the user's body can have a way to locate themselves or restrict themselves during exercise. As illustrated in block 810, the user can move one or more appendages proximate to the user interface and engage the apparatus to conduct an exercise. As illustrated by block 812, the user can adjust the size of user interface to fit the users appendage such as a finger, a wrist an elbow a shoulder a neck a toe an ankle a knee a hip or a torso. As illustrated in block 814, the system can identify the user using an identification system to including a user input device, an identifier carried on the user or a biometric sensor.

As illustrated in decision block 816, it can be determined if the system is going to perform manual manipulation or just be responsive to the user's input or a combination thereof according to a therapy routine prescribed by a professional. If the apparatus is set to perform manual manipulation, as illustrated by block 818, a therapist can be entered a routine into the system similar to how a machinist enters a routine or enters a program into a machine tool that does three or four dimensional motions. The routine can have a pattern, path, dwell number of cycles and all features known in the art of machining.

As illustrated by decision block 820, it can be determined if the user desires to measure or monitor his/her performance of activity relative to the machine. As illustrated by block 822, according to the users setting, the system can control nearly all, if not all, aspects or parameters of the user interface as it is at rest and as it moves about the semisphere. As illustrated by block decision block 824, if the user selects to monitor their performance at decision lock 820, the monitoring system can relate the user to the data and initialize and activate measuring system to monitor the user's performance 824.

As illustrated in block 826, the system implementing the user's settings and automated or controlled settings can control movement of the user interface over the semispherical path as defined above. As illustrated by block 828, the system can take hundreds of measurements as the user exercises. As illustrated by block 830, the system can send data related to the monitoring to the central database. As illustrated in block 832, based on the monitoring of the exerciser's use and activity related to the system, it can be determined if the user has configured the apparatus in an appropriate or optimum configuration. If it is determined that the user has not set the system or apparatus in an appropriate or an optimum configuration the system can provide feedback or input to the user via audio or video feed back and can suggest improved settings or corrective action 832. Thereafter the process can end.

The system, method and apparatus or arrangements can most effectively provide hemispherical resistance to movement of appendages to improve upon how existing equipment exercises specialized multidimensional movements of areas of the body such as the neck, the wrist, the ankle, and the torso which require a wide range of motion and effective resistance over this range. Members can rotate in relation to a frame and the user interface 4 (second member) can move in relation to the first member to create the semispherical motion. As a user pushes on the user interface 4 in any of an X-Y direction the user interface 4 travels in a controlled arcuate three-dimensional motion and rotates as it translates. The user interface 4 can be attached to a lead 56 (rope, wire or cable) and the lead 56 can hold the user interface 4 at a rest position or unbiased position and can also provide a force on the user interface 4 to resist the force applied to the user interface. The lead 56 can be attached to an adjustable resistance system 46 and/or a damping system that resists the movement of the user interface to reduce the chance of injury. The lead 56 can draw out of the expandable orifice or sphincter located at a fixed, semi-fixed or adjustable location via rollers secured by fairlead assembly 55.

It can be appreciated that many mechanical configurations can be utilized to allow the user interface 4 to travel in an arcuate path in the direction which it is pushed over a semispherical surface. It is preferable that the path of the user interface 4 corresponds to the rotation of the users push point of an appendage contact point about a bone socket or one or more vertebra pivots. One way to implement the arcuate semispherical path is to place the pivot(s) of the mechanical members on the same plane (X and/or Y plane) as the users joint to be exercised. Other mechanical configurations can be implemented which act as virtual pivot points having one or more pivot points that are not on plane with the appendage pivot yet operate as though they are at such a pivot.

The force exerted by the user can measured over the entire range of motion (semispherical surface) using a strain gauge or a pressure gauge and/or motion acceleration direction or position sensors 62. The fairlead assembly 55 and resistance system 46 can be coupled to a third member which allows the fairlead assembly 55 to be moved to multiple locations thus changing the rest position or unbiased position of the user interface 4 and thus, the start location of the user interface. The location of the user interface 4 in relation to the pivot points can be adjusted and thus the path traveled by the user interface 4 can be modified in many dimensions.

The foregoing is a detailed description of preferred embodiments of the invention. Various modifications and additions can be made without departing from the spirit and scope of the invention. Accordingly, this description is only meant to be taken by way of example and not to otherwise limit the scope of the invention.

A list of the components are as follows: 1, Exercise Apparatus; 2, Y axis pivot system; 3, section AA; 4, User Interface; 6, Upper Horizontal Member; 8, Lower Horizontal Member; 10, First Vertical Member; 12, Second Vertical Member; 14, First User Interface Pivot; 16, Second User Interface Pivot; 17, Third User Interface Pivot; 18, First Pivot; 20, Second Pivot; 22, Third Pivot; 24, Fourth Pivot; 26, Fifth Pivot; 28, Sixth Pivot; 30, Y Axis Pivot; 32, Counterbalance; 35 User interface in un-biased position, 36 Data blocks, 37 User interface in biased position; 38 clock reference positions, 40, Base; 42, First Frame Upright; 44, Second Frame upright; 46, Resistance system; 48, Weight Stack; 50, Hand Grip; 52, Y Axis Pivot Bearing; 55 Fairlead assembly; 54 Lead; 58, Weight Pulley; 60, Height Adjust Pulley; 62, Sensors; 64, Path Adjustment; 66, Height Adjustment System; 68, Jack; 70, First inner telescopic member; 72, Second inner telescopic member; 74, Local Computer; 76, Transceiver; 77 Sensor monitoring system; 78, Internet; 80, Remote Computer; 82, Motion Detector; 704, First roller yoke (FRY); 706, FRY pivot; 708, Second roller yoke (SRY); 710, SRY pivot; 712, SRY spring; yoke travel limiters 714, 716, FRY spring; 720, First roller; 722, Second roller; 724, First pulley; 726, Second pulley; and 728, Bearing.

It will be apparent to those skilled in the art having the benefit of this disclosure that the present invention contemplates methods, systems, and media that can automatically tune a transmission line. It is understood that the form of the invention shown and described in the detailed description and the drawings are to be taken merely as examples. It is intended that the following claims be interpreted broadly to embrace all the variations of the example embodiments disclosed.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims. The descriptions below are designed to make such embodiments obvious to a person of ordinary skill in the art.

While specific embodiments will be described below with reference to particular configurations of hardware and/or software, those of skill in the art will realize that embodiments of the present invention may advantageously be implemented with other equivalent hardware and/or software systems. Aspects of the disclosure described herein may be stored or distributed on computer-readable media, including magnetic and optically readable and removable computer disks, as well as distributed electronically over the Internet 78 or over other networks, including wireless networks. Data structures and transmission of data (including wireless transmission) particular to aspects of the disclosure are also encompassed within the scope of the disclosure.

What is claimed is:

1. A system comprising:

a user interface having a first orientation in an unbiased position, and a second orientation in one of a plurality of biased positions; and a four bar parallelogram linkage having a first member that remains substantially parallel to the user interface as the user interface is displaced from an unbiased position to at least one of a plurality of biased positions about a semispherical surface, the semispherical surface substantially defined by an origin and a radius where the first member is connected to resistance system that provides a selectable resistance.

2. The system of claim 1 wherein positions on the semispherical surface are defined by an origin, a radius and an angle of displacement.

3. The system of claim 1, further comprising a sensor to identify a user and sense a parameter related to a user's input to the user interface and movement associated with the user interface to create user data.

4. The system of claim 3, wherein sensor data is created by one of a strain gage, an accelerometer, motion detector, an angular rate sensor, a position sensor, a camera or a user identifier module.

5. The system of claim 1, wherein the appendage creates an initial pressure point on the user interface during exercise and as the user interface moves about a range of motion defined by the semispherical surface wherein the user interface's movement is confined such that the user interface remains in contact with the initial pressure point of the appendage throughout a range of motion of the exercise.

6. The system of claim 1, wherein in response to a user's input, the user interface via the resistance system provides a uniform resistance to the movement of the user interface about a range of motion of the user interface.

7. The system of claim 1, wherein the user interface is adapted to interface with one of the neck, the wrist, the ankle, and the torso.

8. The system of claim 1, further comprising an adjuster to adjust one of a position of the user interface, a body position, a resistance setting, a user interface setting, or a user interface path setting.

9. An apparatus comprising:

a frame;

a first member coupleable to the frame, a rotating member and a resistance system, a second member coupled to the first member;

a third member coupled to the first and second member; and a fourth member coupled to the first second and third member where the first second and third member form a parallelogram linkage where the rotating member is coupled to the frame via a pivot that allows the parallelogram linkage to pivot in relation to the frame;

a user interface coupled to the parallelogram linkage wherein the parallelogram linkage controls movement of the user interface to locations substantially defined by a semispherical surface and a counter weight coupled to the parallelogram linkage to assist in bringing the user interface back to an unbiased position from a biased position.

10. The apparatus of claim 9 wherein the semispherical surface has a positive Gaussian curvature.

11. The apparatus of claim 9 wherein locations on the semispherical surface can be defined by umbilical points.

12. The apparatus of claim 9 further comprising a counter balance to bias the location of the user interface to a rest position.

13. The apparatus of claim 9 wherein when the user interface moves from a unbiased position, the first and second members pivot in relationship the frame forcing the user interface to simultaneously rotate and translate remaining substantially tangent to a path defined substantially by an equation for an imaginary semispherical surface.

14. The apparatus of claim 9 wherein when the user interface moves from an unbiased position in a direction the user interface has an X, a Y and a Z component.

15. The apparatus of claim 9 further comprising a start adjustment member to adjust a start location of the user interface on the semispherical surface.

16. The apparatus of claim 9 wherein when the user interface movement is defined by a displacement from a rest position the displacement being a curved path defined by a center and a radius that is substantially equal to a length of one of a human body appendages.

17. The apparatus of claim 9 further comprising at least one sensor to monitor activity of a user of the apparatus and transmitting sensor data to a data collection apparatus.

18. The apparatus of claim 9 further comprising at least part of a communication network to communicate the sensor data to a remote location.

19. A system comprising:

a user interface; and a first second third and fourth rigid member linked to each other and to the interface via a plurality of pivots, and linked to a frame by a pivot, where during operation the first and second members move in a substantially parallel relationship with each other, and the second and third members travel in a substantially parallel relationship with each other, where the first rigid member is not directly connected to the user interface and is connectable to a resistance system and where the first, second, third and fourth members are rotatable about the pivot such that movement of the user interface to an unbiased position forces the user interface to rotate when it translates.

* * * * *